US009865916B2

(12) United States Patent
Chang et al.

(10) Patent No.: US 9,865,916 B2
(45) Date of Patent: Jan. 9, 2018

(54) ANTENNA STRUCTURE AND WIRELESS COMMUNICATION DEVICE USING THE ANTENNA STRUCTURE

(71) Applicant: Chiun Mai Communication Systems, Inc., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 301 days.

(21) Appl. No.: 14/524,469

(22) Filed: Oct. 27, 2014

(65) Prior Publication Data

US 2015/0188214 A1 Jul. 2, 2015

(30) Foreign Application Priority Data

Dec. 31, 2013 (CN) ..... 2013 1 0747898

(51) Int. Cl.
*H01Q 1/24* (2006.01)
*H01Q 7/00* (2006.01)
*H01Q 5/335* (2015.01)

(52) U.S. Cl.
CPC ..... *H01Q 1/243* (2013.01); *H01Q 5/335* (2015.01); *H01Q 7/00* (2013.01)

(58) Field of Classification Search
CPC ..... H01Q 1/243; H01Q 5/335; H01Q 7/00
See application file for complete search history.

(56) References Cited

U.S. PATENT DOCUMENTS 6,031,505 A * 2/2000 Qi ..... H01Q 1/243 343/725
6,329,951 B1 * 12/2001 Wen ..... H01Q 1/243 343/702
2004/0113847 A1 * 6/2004 Qi ..... H01Q 1/243 343/702
2009/0160713 A1 * 6/2009 Nielsen ..... H01Q 1/243 343/702
2013/0201074 A1 * 8/2013 Harper ..... H01Q 1/38 343/870

* cited by examiner

*Primary Examiner* — Dieu H Duong
*Assistant Examiner* — Michael Bouizza
(74) *Attorney, Agent, or Firm* — ScienBiziP, P.C.

(57) ABSTRACT

An antenna structure includes an antenna holder, a radiating body, a feed portion, and a grounding portion. The antenna holder includes a plurality of surfaces. The feed portion is positioned on one surface of the antenna holder and electronically connected to a first end of the radiating body. The ground portion is positioned on one surface of the antenna holder and electronically connected to a second end of the radiating body so as to form a loop antenna. An electronic element is surrounded by the loop antenna.

13 Claims, 3 Drawing Sheets

ANTENNA STRUCTURE AND WIRELESS COMMUNICATION DEVICE USING THE ANTENNA STRUCTURE

FIELD

The subject matter herein generally relates to an antenna structure and a wireless communication device using the antenna structure.

BACKGROUND

Antennas are important elements of wireless communication devices, such as mobile phones, tablets, laptops, or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
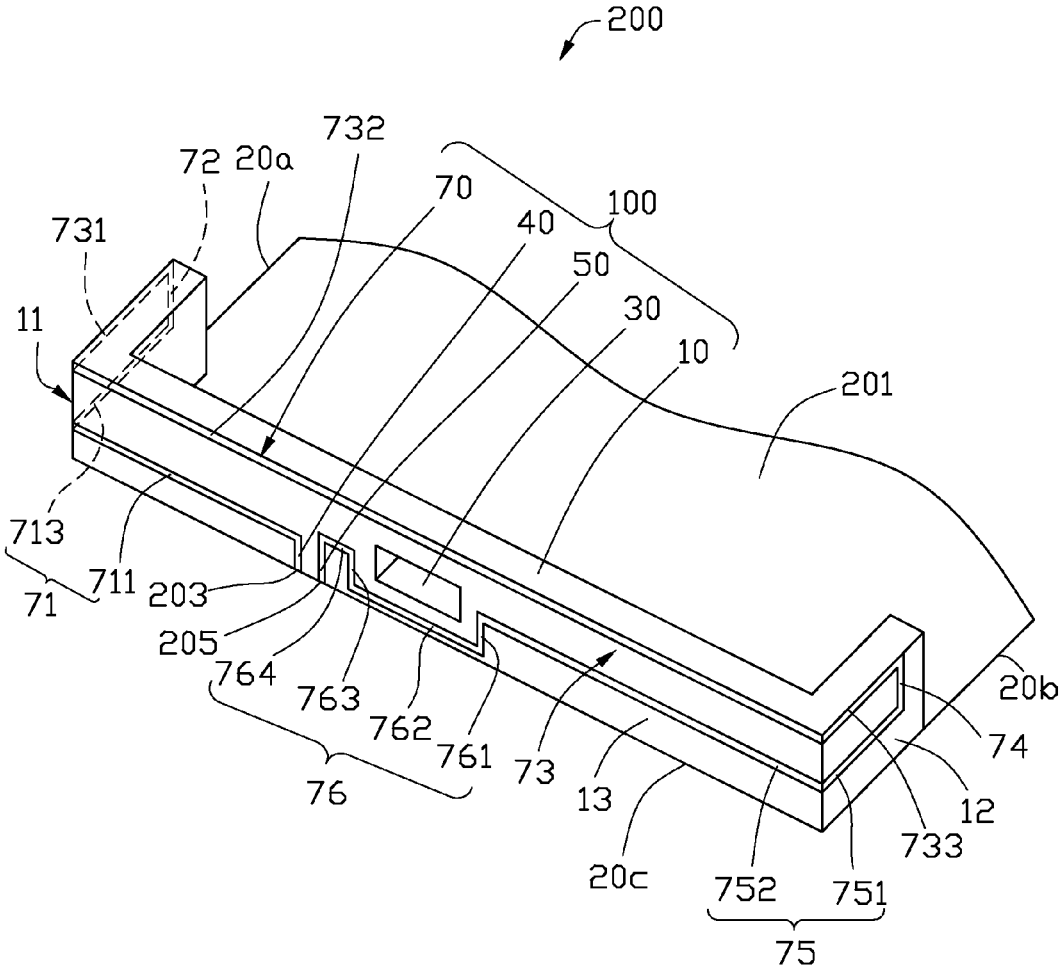
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 200. The wireless communication device 200 can be a mobile phone, a tablet, a laptop, or a personal digital assistant, for example. The wireless communication device 200 includes a grounding plane 201 and an antenna structure 100.

In this embodiment, the grounding plane 201 is formed by a metal housing of the wireless communication device 200. The grounding plane 201 includes a first edge 20*a*, a second edge 20*b*, and a third edge 20*c*. The first edge 20*a* is spaced from, and parallel to, the second edge 20*b*. The third edge 20*c* is perpendicularly connected to the first edge 20*a* and the second edge 20*b*. A signal feed terminal 203 and a signal grounding terminal 205 are positioned on the third edge 20*c* and spaced from each other.

The antenna structure 100 includes an antenna holder 10, an electronic element 30, a feed portion 40, a grounding portion 50, and a radiating body 70.

The antenna holder 10 can be made of a dielectric material, such as an epoxy resin glass fiber, and is perpendicularly positioned on the grounding plane 201 along the first edge 20*a*, the third edge 20*c* and the second edge 20*b*. In this embodiment, the feed portion 40, the grounding portion 50, and the radiating body 70 are all positioned on a surface of the antenna holder 10. A first end of the radiating body 70 is electronically connected to the feed portion 40. A second end of the radiating body 70 is electronically connected to the grounding portion 50. The feed portion 40, the grounding portion 50, and the radiating body 70 cooperatively form a loop antenna.

In this embodiment, the antenna holder 10 is substantially U-shaped and includes a first surface 11, a second surface 12, and a third surface 13. The first surface 11 is spaced from, and parallel to, the second surface 12. The third surface 13 is perpendicularly connected to the first surface 11 and the second surface 12. In this embodiment, the first surface 11 is positioned on and collinear with the first edge 20*a*. The second surface 12 is positioned on and collinear with the second edge 20*b*. The third surface 13 is positioned on and collinear with the third edge 20*c*.

The electronic element 30 can be a universal serial bus connector or a speaker. The electronic element 30 is positioned on the third surface 13 and is surrounded by the loop antenna.

The feed portion 40 and the grounding portion 50 are both positioned on the third surface 13 of the antenna holder 10. The feed portion 40 is substantially a strip and is perpendicularly connected to the signal feed terminal 203 to feed current to the antenna structure 100. The grounding portion 50 is substantially a strip, and is spaced from and parallel to the feed portion 40. The grounding portion 50 is perpendicularly connected to the grounding end 205 to ground the antenna structure 100.

The radiating body 70 includes a first radiating portion 71, a second radiating portion 72, a third radiating portion 73, a fourth radiating portion 74, a fifth radiating portion 75, and a sixth radiating portion 76 connected in order. The first radiating portion 71 is positioned on the first surface 11 and the third surface 13. The first radiating portion 71 includes a first radiating section 711 and a second radiating section 713. The first radiating section 711 is substantially a strip and is positioned on the third surface 13. The first radiating section 711 is perpendicularly connected to an end of the feed portion 40 away from the signal feed terminal 203, and extends towards the first surface 11 to be spaced from and parallel to the third edge 20*c*. The second radiating section 713 is substantially a strip and is positioned on the first surface 11. The second radiating section 713 has a first end perpendicularly connected to an end of the first radiating section 711 away from the feed portion 40 and a second end perpendicularly connected to the second radiating portion 72. In this embodiment, the second radiating section 713 is spaced from and parallel to the first edge 20*a*.

The second radiating portion 72 is substantially a strip and is coplanar with the second radiating section 713. The second radiating portion 72 is perpendicularly connected to an end of the second radiating section 713 away from the first radiating section 711, and extends away from the first edge 20*a*.

The third radiating portion 73 is positioned on the first surface 11, the second surface 12, and the third surface 13. The third radiating portion 73 includes a first combining section 731, a second combining section 732, and a third combining section 733 connected in order. The first combining section 731 is positioned on the first surface 11 of the antenna holder 10. The first combining section 731 is perpendicularly connected to an end of the second radiating portion 72 away from the second radiating section 713 to be parallel to the second radiating section 713. The second combining section 732 is substantially a strip and is positioned on the third surface 13 of the antenna holder 10. The second combining section 732 is electronically connected to an end of the first combining section 731 away from the second radiating portion 72. The second combining section 732 is spaced from and parallel to the first radiating section 711. In this embodiment, a length of the second combining section 731 is greater than a length of the first radiating section 711. The third combining section 733 is substantially a strip and is positioned on the second surface 12. The third combining section 733 is perpendicularly connected to an end of the second combining section 732 away from the first combining section 731.

The fourth radiating portion 74 is substantially a strip and is coplanar with the third combining section 733. The fourth radiating portion 74 is perpendicularly connected to an end of the third combining section 733 away from the second combining section 732, and extends towards the second edge 20*b*.

The fifth radiating portion 75 is positioned on the second surface 12 and the third surface 13. The fifth radiating portion 75 includes a first connecting section 751 and a second connecting section 752. The first connecting section 751 is substantially a strip and is positioned on the second surface 12. The first connecting section 751 is perpendicularly connected to an end of the fourth radiating portion 74 away from the third combining section 733 to be spaced from and parallel to the third combining section 733. The second connecting section 752 is substantially a strip and is positioned on the third surface 13. The second connecting section 752 is perpendicularly connected to an end of the first connecting section 751 away from the fourth radiating portion 74 and is spaced from and parallel to the second combining section 732.

The sixth radiating portion 76 is positioned on the third surface 13 and includes a first coupling section 761, a second coupling section 762, a third coupling section 763, and a fourth coupling section 764 connected in order. The first coupling section 761 is perpendicularly connected to an end of the second connecting section 752 away from the first connecting section 751, and extends towards the third edge 20*c*. A first end of the second coupling section 762 is perpendicularly connected to an end of the first coupling section 761 away from the second connecting section 752. A second end of the second coupling section 762 is perpendicularly connected to the third coupling section 763. In this embodiment, the first coupling section 761, the second coupling section 762, and the third coupling section 763 cooperatively form a U-shaped structure configured to surround the electronic element 30. The fourth coupling section 764 is substantially a strip. A first end of the fourth coupling section 764 is perpendicularly connected to an end of the third coupling section 763 away from the second coupling section 762. A second end of the fourth coupling section 764 is perpendicularly connected to an end of the grounding portion 50 away from the signal ground end 205. In this embodiment, the fourth coupling section 764 is collinear with the second connecting section 752.

Figure 2:
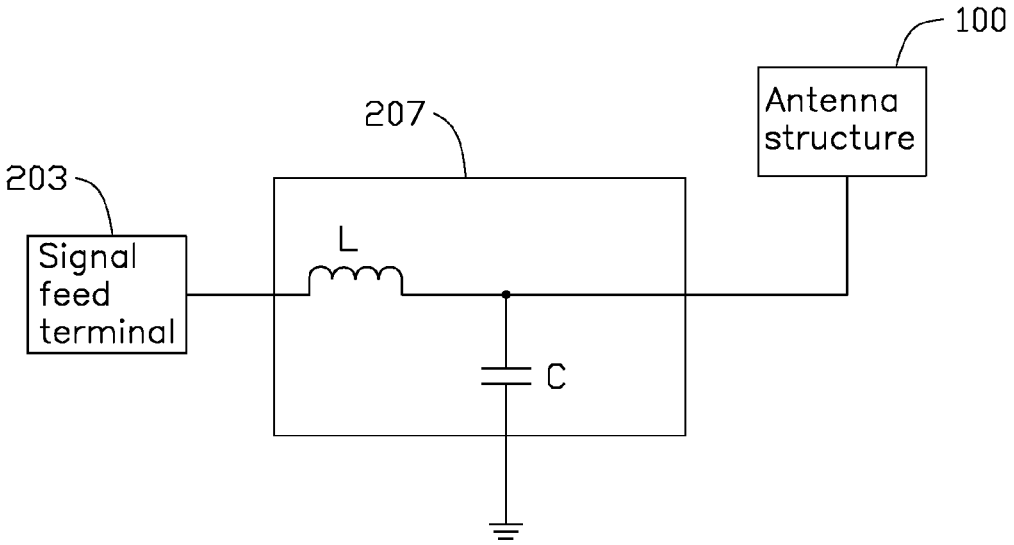
FIG. 2 is a block diagram of a matching circuit of the wireless communication device of FIG. 1.

FIG. 2 shows the wireless communication device 200 further includes a matching circuit 207. The matching circuit 207 is electronically connected between the signal feed terminal 203 and the antenna structure 100. In this embodiment, the matching circuit 207 includes an inductor L and a capacitor C. The inductor L is connected between the signal feed terminal 203 and the antenna structure 100. A first end of the capacitor C is electronically connected between the inductor L and the antenna structure 100. A second end of the capacitor C is grounded. Then, an impedance of the antenna structure 100 can be matched for adjusting a high-frequency mode or a low-frequency mode of the antenna structure 100 through adjusting a capacitance of the capacitor C or an inductance of the inductor L.

Figure 3:
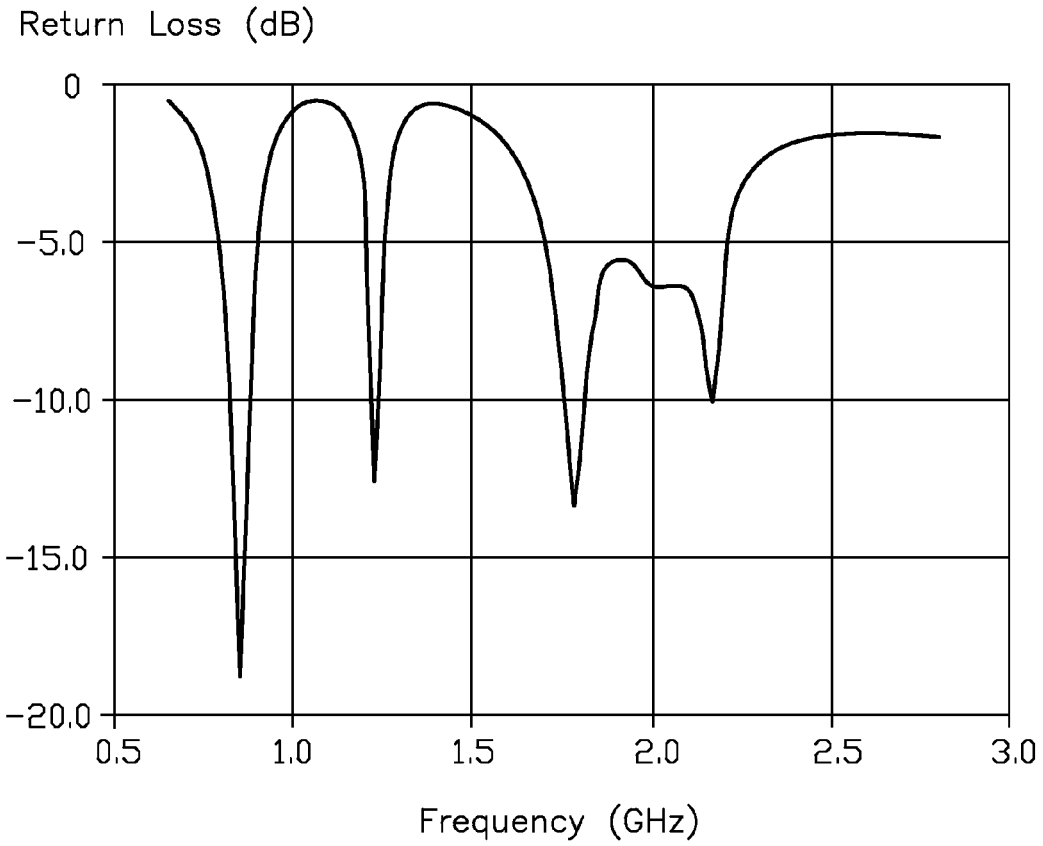
FIG. 3 is a return loss (RL) graph of the antenna structure of the wireless communication device of FIG. 1.

FIG. 3 is a return loss (RL) graph of the antenna structure 100. As shown, the antenna structure 100 has a good performance when operating at frequency bands of about 800-900 MHz and 1710-2170 MHz, and satisfies radiation requirements.

In other embodiments, the third radiating portion 73 can be positioned on a top edge of the antenna holder 10 away from the grounding plane 201 so that the antenna structure 100 can obtain better radiating efficiency and frequency band.

In other embodiments, the antenna holder 10 can be L-shaped, that is, one of the first surface 11 and the second surface 12 can be omitted. When the first surface 11 is omitted, the radiating body 70 is positioned on the second surface 12 and the third surface 13. Then, the second radiating section 713 and the first combining section 731 are both omitted, and the second radiating portion 72 is positioned on the third surface 13 and is perpendicularly connected between the first radiating section 711 and the second combining section 732.

When the second surface 12 is omitted, the radiating body 70 is positioned on the first surface 11 and the third surface 13. Then, the third combining section 733 and the first connecting section 751 are both omitted, and the fourth radiating portion 74 is positioned on the third surface 13 and is perpendicularly connected between the second combining section 732 and the second connecting section 752.

In other embodiments, the antenna holder 10 can be rectangular, that is, the first surface 11 and the second surface 12 can both be omitted, and the radiating body 70 is only positioned on the third surface 13. Then, the second radiating section 713, the first combining section 731, the third combining section 733, and the first connecting section 751 are all omitted. The second radiating portion 72 is positioned on the third surface 13 and is perpendicularly connected between the first radiating section 711 and the second combining section 732, and the fourth radiating portion 74 is positioned on the third surface 13 and is perpendicularly connected between the second combining section 732 and the second connecting section 752.

The embodiments shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

an antenna holder, the antenna holder comprising a first surface, a second surface, and a third surface, wherein the first surface is spaced apart from and parallel to the second surface, the third surface is perpendicularly connected to the first surface and the second surface;

a radiating body comprising a first end and a second end;

a feed portion positioned on the third surface, wherein the feed portion is electronically connected to the first end of the radiating body and is configured to feed current to the antenna structure; and a ground portion positioned on the third surface and configured to ground the antenna structure, wherein the ground portion is electronically connected to the second end of the radiating body so as to form a loop antenna; and an electronic element surrounded by the loop antenna;

wherein the radiating body comprises a first radiating portion, a second radiating portion, a third radiating portion, a fourth radiating portion, a fifth radiating portion, and a sixth radiating portion; wherein the first radiating portion comprises a first radiating section and a second radiating section; the first radiating section is positioned on the third surface and is perpendicularly connected to an end of the feed portion; the second radiating section has a first end perpendicularly connected to an end of the first radiating section away from the feed portion and a second end perpendicularly connected to the second radiating portion;

wherein the third radiating portion comprises a first combining section, a second combining section, and a third combining section connected in order; the first combining section is perpendicularly connected to an end of the second radiating portion away from the second radiating section to be parallel to the second radiating section; the second combining section is electronically connected to an end of the first combining section away from the second radiating portion, and is spaced from and parallel to the first radiating section; and the third combining section is perpendicularly connected to an end of the second combining section away from the first combining section;

wherein the fourth radiating portion is a strip and is perpendicularly connected to an end of the third combining section away from the second combining section;

wherein the fifth radiating portion comprises a first connecting section and a second connecting section, the first connecting section is perpendicularly connected to an end of the fourth radiating portion away from the third combining section, and the second connecting section is perpendicularly connected to an end of the first connecting section away from the fourth radiating portion and is spaced from and parallel to the second combining section; and wherein the sixth radiating portion comprises a first coupling section, a second coupling section, a third coupling section, and a fourth coupling section connected in order, the first coupling section is perpendicularly connected to an end of the second connecting section away from the first connecting section; a first end of the second coupling section is perpendicularly connected to an end of the first coupling section away from the second connecting section, and a second end of the second coupling section is perpendicularly connected to the third coupling section; the fourth coupling section is perpendicularly connected between the third coupling section and the grounding portion, the first coupling section and the third coupling section are positioned at a same side of the second coupling section, and the first coupling section, the second coupling section, and the third coupling section cooperatively form a U-shaped structure.

2. The antenna structure of claim 1, wherein the fourth coupling section is collinear with the second connecting section, the first coupling section, the second coupling section, and the third coupling section cooperatively surround the electronic element.

3. The antenna structure of claim 1, wherein the second radiating section, the second radiating portion, and the first combining section are positioned on the third surface.

4. The antenna structure of claim 1, wherein the second radiating section, the second radiating portion, and the first combining section are positioned on the first surface.

5. The antenna structure of claim 1, wherein the third combining section, the fourth radiating portion, and the first connecting section are positioned on the third surface.

6. The antenna structure of claim 1, wherein the third combining section, the fourth radiating portion, and the first connecting section are positioned on the second surface.

7. A wireless communication device comprising:

a grounding plane; and an antenna structure positioned on the ground plane, the antenna structure comprising:

an antenna holder, the antenna holder comprising a first surface, a second surface, and a third surface, wherein the first surface is spaced apart from and parallel to the second surface, the third surface is perpendicularly connected to the first surface and the second surface;

a radiating body comprising a first end and a second end;

a feed portion positioned on the third surface, wherein the feed portion is electronically connected to the first end of the radiating body and is configured to feed current to the antenna structure; and a grounding portion positioned on the third surface and configured to ground the antenna structure, wherein the ground portion is electronically connected to the second end of the radiating body so as to form a loop antenna; and an electronic element surrounded by the loop antenna;

wherein the radiating body comprises a first radiating portion, a second radiating portion, a third radiating portion, a fourth radiating portion, a fifth radiating portion, and a sixth radiating portion; wherein the first radiating portion comprises a first radiating section and a second radiating section; the first radiating section is positioned on the third surface and is perpendicularly connected to an end of the feed portion; the second radiating section has a first end perpendicularly connected to an end of the first radiating section away from the feed portion and a second end perpendicularly connected to the second radiating portion;

wherein the third radiating portion comprises a first combining section, a second combining section, and a third combining section connected in order; the first combining section is perpendicularly connected to an end of the second radiating portion away from the second radiating section to be parallel to the second radiating section; the second combining section is electronically connected to an end of the first combining section away from the second radiating portion, and is spaced from and parallel to the first radiating section; and the third combining section is perpendicularly connected to an end of the second combining section away from the first combining section;

wherein the fourth radiating portion is a strip and is perpendicularly connected to an end of the third combining section away from the second combining section;

wherein the fifth radiating portion comprises a first connecting section and a second connecting section, the first connecting section is perpendicularly connected to an end of the fourth radiating portion away from the third combining section, and the second connecting section is perpendicularly connected to an end of the first connecting section away from the fourth radiating portion and is spaced from and parallel to the second combining section; and wherein the sixth radiating portion comprises a first coupling section, a second coupling section, a third coupling section, and a fourth coupling section connected in order, the first coupling section is perpendicularly connected to an end of the second connecting section away from the first connecting section; a first end of the second coupling section is perpendicularly connected to an end of the first coupling section away from the second connecting section, and a second end of the second coupling section is perpendicularly connected to the third coupling section; the fourth coupling section is perpendicularly connected between the third coupling section and the grounding portion, the first coupling section and the third coupling section are positioned at a same side of the second coupling section, and the first coupling section, the second coupling section, and the third coupling section cooperatively form a U-shaped structure.

8. The wireless communication device of claim 7, further comprising a matching circuit, wherein a signal feed terminal is positioned on the grounding plane, the signal feed terminal is electronically connected to the feed portion; the matching circuit comprises a capacitor and an inductor, the inductor is electronically connected between the signal feed terminal and the antenna structure; and the capacitor has a first end connected between the inductor and the antenna structure and a second end grounded.

9. The wireless communication device of claim 7, wherein the fourth coupling section is collinear with the second connecting section, the first coupling section, the second coupling section, and the third coupling section cooperatively surround the electronic element.

10. The wireless communication device of claim 7, wherein the second radiating section, the second radiating portion, and the first combining section are positioned on the third surface.

11. The wireless communication device of claim 7, wherein the second radiating section, the second radiating portion, and the first combining section are positioned on the first surface.

12. The wireless communication device of claim 7, wherein the third combining section, the fourth radiating portion, and the first connecting section are positioned on the third surface.

13. The wireless communication device of claim 7, wherein the third combining section, the fourth radiating portion, and the first connecting section are positioned on the second surface.

* * * * *